United States Patent [19]

Greer et al.

[11] Patent Number: 4,763,313

[45] Date of Patent: Aug. 9, 1988

[54] PLURAL ORIENTATION WATCH MOUNT

[75] Inventors: Jerry A. Greer, Woodland Hills; Lisa J. Lowe, Santa Barbara, both of Calif.

[73] Assignee: Partz Partnership, Fullerton, Calif.

[21] Appl. No.: 25,480

[22] Filed: Mar. 13, 1987

[51] Int. Cl.[4] ..... G04B 37/00; A47F 7/00

[52] U.S. Cl. ..... 368/317; 248/115

[58] Field of Search ..... 368/276, 278, 316–317, 368/327; 248/114–116

[56] References Cited

U.S. PATENT DOCUMENTS

| | | | |
|---|---|---|---|
| 2,181,753 | 11/1939 | Wewetzer et al. | 368/316 |
| 4,362,402 | 12/1982 | Kallinke et al. | 368/317 |
| 4,491,425 | 1/1985 | Young-Koo | 368/317 |

FOREIGN PATENT DOCUMENTS

| | | | |
|---|---|---|---|
| 2124861 | 11/1972 | Fed. Rep. of Germany | 368/316 |

*Primary Examiner*—Vit W. Miska

*Attorney, Agent, or Firm*—G. Donald Weber, Jr.

[57] ABSTRACT

A plural-orientation watch mount which includes a receptacle adapted to retentionally receive a subject wrist watch, a carrier adapted for mountability onto an independent structure of interest, and means for the selective orientation of the receptacle onto the carrier.

As preferably embodied, the subject mounting means more specifically includes a dovetailed male connection between subject carrier and receptacle. Advantageously, two grooves may be configured at essentially 90-degrees relative to each other so as to accordingly provide mount fixations at essentially 90-degree intervals.

The receptacle itself may, in turn, be more specifically designed so as to define a surface configuration to receive a watch of the pin-tabbed variety. A first side of the receptacle would then preferably be adapted for an inserted-pin securement of a first tabbed-side of this type of watch, with an opposite second side of the receptacle being sized for a press-fit securement of an opposite second tabbed side of the watch.

The carrier may designed so as to define strap-attachment slots by means of which a strap may be employed to secure the carrier to an independent structure of interest.

9 Claims, 1 Drawing Sheet

Fig. 1a.
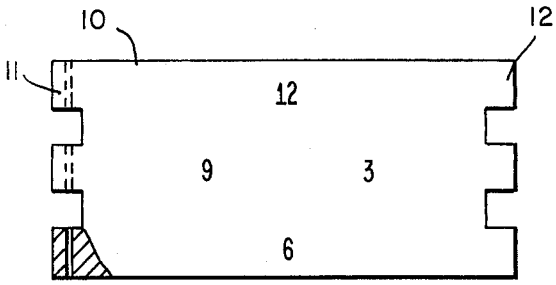
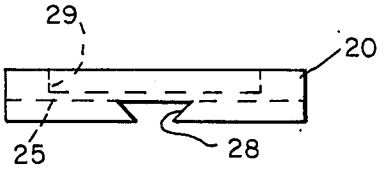
Fig. 2a.
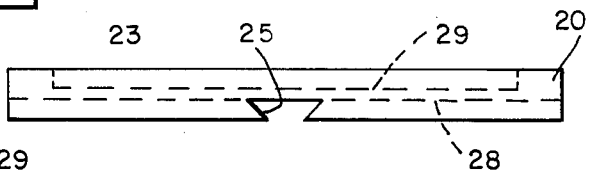
Fig. 2b.
Fig. 1b.
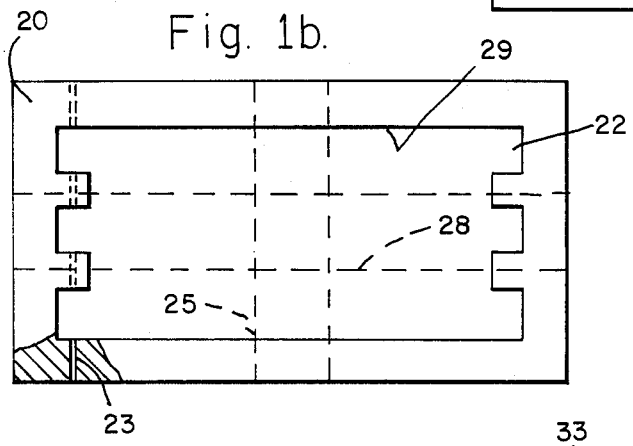
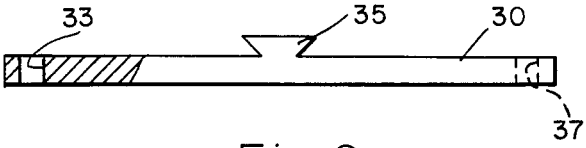
Fig. 2c.
Fig. 1c.
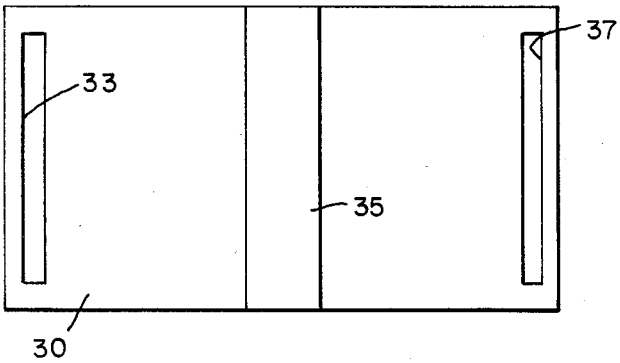
Fig. 3.
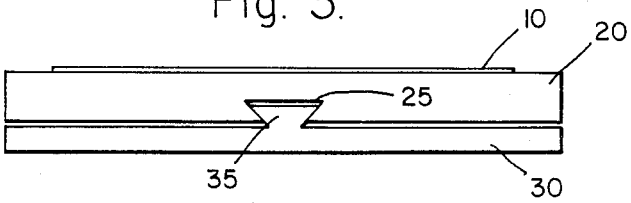

PLURAL ORIENTATION WATCH MOUNT

BACKGROUND OF THE INVENTION

1. Field of the Invention

The invention relates, in general, to accessories for wrist watches and relates, in particular, to fixtures which enable such watches to be mounted on a variety of structures besides a person's wrist. The invention, more specifically, includes special means for enabling the orientation of a resultantly-mounted watch to be selectably altered.

It is to be noted, however, that while the subject invention will be described with reference to particularized embodiments and end uses, the invention is not limited to such embodiments and uses. Those having ordinary skill in the art and access to the teachings of this specification will recognize additional implementations and utilizations which are within the scope of this invention.

2. Background Art

The "Swatch-Watch" brand of wrist watches features a thin, rugged configuration available in a variety of designer colors with an assortment of interchangable an variously-colored watch bands. The resultant versatility has accordingly made the "Swatch Watch" a popular adjunct to "youthfully-active" lifestyles.

It has now been perceived, however, that the versatility of such watches would be further enhanced by supplementing them with fixtures which are in turn adapted for plural-orientation mounting on a variety of structures besides a person's wrist.

SUMMARY OF THE INVENTION

The present invention accordingly provides a plural-orientation watch mount which includes a receptacle adapted to retentionally receive a subject wrist watch, a carrier adapted for mountability onto an independent structure of interest, and means for the selectably orientation-alterable mounting of the receptacle onto the carrier.

As preferably embodied, the subject receptacle mounting means contemplates dovetailed male fitting (tenon) and female grooves (mortises) respectively formed into the carrier and the receptacle. Advantageously, two such female grooves may be configured at essentially 90-degrees relative to each other so as to accordingly provide alterable mount fixations at essentially 90-degree intervals.

The receptacle itself may, in turn, be more specifically designed to define a surface aperture of companion planar configuration to a watch of the pin-tabbed variety. A first side of the receptacle is preferably adapted for an inserted-pin securement of a first tabbed side of the watch. The an opposite, second tabbed side of the receptacle is sized for a press-fit securement of an opposite second tabbed side of the watch.

The carrier may, in turn, be more specifically designed so as to bilaterally define strap-attachment slots by means of which a strap may be employed to secure the carrier to a given independent structure of interest.

BRIEF DESCRIPTION OF THE DRAWINGS

FIGS. 1*a*, 1*b* and 1*c* respectively represent top planar views of a subject wrist watch, a planar-apertured retention receptacle for the watch and a companion carrier bracket onto which the receptacle may be mounted in different orientations;

FIGS. 2*a*, 2*b* and 2*c* respectively represent lateral and longitudinal side views of the receptacle illustrated in FIG. 1*b* and a longitudinal side view of the carrier illustrated in 1*c*.

FIG. 3 represents a side or plan view of one embodiment of an assembly comprising a watch, a receptacle and a carrier.

DETAILED DESCRIPTION OF A PREFERRED EMBODIMENT

With reference to the example illustrated in the Figures, the invention generally entails an apparatus which enables a time piece, such as the popular line of "Swatch Watch" wrist watches, to be not only mounted on a variety of structures besides a wrist, but to be so mounted in a manner which enables the relative fixed orientation between the watch and the amount and, hence between the watch and the structure of interest, to be selectably altered.

The illustrated apparatus thus includes receptacle 20 which is configured to retentionally receive at one of its planar surfaces a subject watch 10. For mounting onto carrier 30, receptacle 20 possesses crossed female grooves 25 and 28, each of dovetailed cross-section and each configured to be slidable onto companionly-dovetailed male fitting 35 of the carrier 30. The essentially mutually-perpendicular relationship of grooves 25 and 28 enables receptacle 20 and, hence watch 10 to be fixedly mounted at different, essentially 90-degree orientations with respect to carrier 30. The fitting and grooves are mutually sized so as to establish a mechanically-secure frictional-engagement when interfitted, while remaining selectably manually-disengagable for alternative orientations as desired. Carrier 30 then further includes suitable means, such as bilateral strap-attachment slots 33 and 37, together with an unillustrated strap, which in turn enable carrier 30 and hence watch 10 to be attached to an independent structure of interest, such as a bicycle handle bar or the like.

Additional features of the inventive embodiment may also be noted. First, it is preliminarily apparent that the respective positions of the described fitting 35 and dovetailed grooves 25 and 28 may be reversed, with receptacle 20 predeterminately being appropriately configured to carry the fitting (tenon) and carrier 30 predeterminately being in a companion fashion appropriately configured to form the subject grooves. Second, with regard to a "Swatch" or related-type wrist watch which more-specifically includes bilateral, essentially pin-tabbed sides 11 and 12, receptacle 20 is accordingly more-specifically designed so as to define a surface aperture 29 of companion planar configuration to a pin-tabbed watch of the subject nature. First side 21 of receptacle 29 is adapted for an inserted-pin-23 securement of first tabbed side 11 of the watch, while opposite second side 22 of receptacle 29 is sized for a press-fit securement of the opposite second tabbed side 12 of the watch. Third, the general layout and precise physical dimensions of the various illustrated components may be appropriately adjusted according to intended operational circumstances such as foreseen independent attachment structures. Fourth, any of a variety of conventional materials may be employed for the construction of the subject components, with a suitable light-weight, generally-rigid plastic being preferred and with the precise selection often being a function of the particular operational circumstances at hand.

The preceeding description has presented in detail exemplary preferred ways in which the concepts of the present invention may be applied. Those skilled in the art will recognize that numerous alternatives encompassing many variations may readily be employed without departing from the spirit and scope of the invention as set forth in the appended claims, in which:

What is claimed is:

1. A plural orientation watch mount comprising:

a receptacle means adapted to retentionally receive a subject wrist watch;

carrier means adapted for mountability onto an independent structure of interest; and mounting means for mounting said receptacle means onto said carrier means in a selectably alterable orientation;

said receptacle means defines a surface aperture of companion planar configuration to a given pin-tabbed watch, with a first side of said aperture being adapted for an inserted-pin securement of a first tabbed side of said watch and with a second side of said aperture being sized for a press-fit securement of a second tabbed side of said watch.

2. A watch mount according to claim 1 in which:

said carrier means defines strap-attachment slots whereby a strap may be employed to secure said carrier means to a given independent structure of interest.

3. A watch mount according to claim 1 in which:

said receptacle means and said carrier means includes dovetailed male fitting means and crossed female grooves.

4. A watch mount according to claim 1 in which:

said mounting means is configured to selectably provide relative orientations at essentially 90-degree intervals.

5. A plural orientation watch mount comprising:

(A) receptacle means adapted to retentionally receive a pin-tabbed watch by defining a surface aperture of companion planar configuration to said watch, with a first side of said aperture adapted for an inserted-pin securement of a first tabbed side of said watch and an opposite second side of said aperture sized for a press-fit securement of an opposite second tabbed side of said watch;

(B) carrier means including at least two strap-attachment slots whereby a strap may be employed to secure said carrier means to an independent structure of interest; and (C) mounting means for selectively mounting said receptacle means onto said carrier means, said mounting means including dovetailed tenon and a pair of 90-degree mortise grooves.

6. An accessory for a timepiece which includes pin-tabbed ends comprising, a substantially planar mounting means having first and second planar surfaces, said mounting means including pin-tabbed ends which are adapted to mate with the pin-tabbed ends of said timepiece, said pin-tabbed ends of said mounting means extending upwardly from a said first surface of said planar mounting means, said second surface of said mounting means including at least one groove formed therein and adapted to slidably receive a mating element for supporting said mounting means.

7. The accessory recited in claim 6 wherein, said second surface includes at least two grooves formed therein each of which is adapted to slidably receive a mating element for supporting said mounting means.

8. The accessory recited in claim 7 wherein, said two grooves are transverse to each other.

9. The accessory recited in claim 7 including, pin means joining said timepiece means to said mounting means at one of the pin-tabbed ends thereof.

* * * * *